US005273222A

United States Patent [19]

Hutzenlaub et al.

[11] Patent Number: 5,273,222

[45] Date of Patent: Dec. 28, 1993

[54] MULTIPLE-STATION WINDING MACHINE FOR THE WINDING OF WEBS OF FOIL OR THE LIKE

[75] Inventors: Armin Hutzenlaub, Wiehl; Peter Orbach, Lindlar; Dietmar Knölke, Gummersbach, all of Fed. Rep. of Germany

[73] Assignee: Kampf GmbH & Co. Maschinenfabrik, Wiehl-Muhlen, Fed. Rep. of Germany

[21] Appl. No.: 883,837

[22] Filed: May 15, 1992

[30] Foreign Application Priority Data

May 15, 1991 [DE] Fed. Rep. of Germany ..... 4115863

[51] Int. Cl.[5] ..... B65H 19/26

[52] U.S. Cl. ..... 242/56 A

[58] Field of Search ..... 242/56 A, 56 R, 56.6, 242/67.1 R, 64

[56] References Cited

U.S. PATENT DOCUMENTS 3,148,843 9/1964 Turner et al. ..... 242/56 A
3,279,718 10/1966 Arterton et al. ..... 242/67.1 R
3,834,642 9/1974 Kampf ..... 242/67.1 R X
4,326,679 4/1982 Phelps et al. ..... 242/56 A
4,343,440 8/1982 Engl ..... 242/67.1 R
4,491,283 1/1985 Pav et al. ..... 242/67.1 R
4,541,583 9/1983 Forman ..... 242/56 A
4,630,783 12/1986 Mulfarth ..... 242/56 A
4,678,133 7/1987 Suzuki ..... 242/56 A
4,993,652 2/1991 Moeller ..... 242/56 A
5,150,848 9/1992 Consani ..... 242/56 R

FOREIGN PATENT DOCUMENTS 1085622 10/1967 United Kingdom .

*Primary Examiner*—John M. Jillions
*Attorney, Agent, or Firm*—Herbert Dubno; Dyuri Kateshov

[57] ABSTRACT

A contact roller is shiftable in two mutually perpendicular directions so that it can press the cut end of a web, e.g. of thin scratch-sensitive film, against an empty roll in a waiting position while maintaining contact with the roll being completely wound in the winding position. The empty sleeve and the wound roll are mounted upon arms of a turret or the like so as to be swingable about a command axis but independently of one another.

16 Claims, 5 Drawing Sheets

MULTIPLE-STATION WINDING MACHINE FOR THE WINDING OF WEBS OF FOIL OR THE LIKE

FIELD OF THE INVENTION

Our present invention relates to a multiple-station winding machine for the winding of webs of flexible material, especially foils or the like, in which a transverse separating device or cutter separates the web into successive lengths as they are wound upon the rolls and longitudinal slitters can be provided to subdivide the web into a plurality of longitudinal strips which are wound up in respective rolls. More particularly, the invention relates to a roll-winding device in which a contact roller presses against the roll as it is wound up and is shiftable in response to the increasing roll diameter.

BACKGROUND OF THE INVENTION

It is known that it is relatively difficult to achieve a uniform winding density in a wound roll which is formed from very thin foils or films. The winding density depends upon air inclusions between the successive turns or layers and upon the web speed and the surface roughness of the web.

An additional problem is that webs of different types have properties which themselves introduce variations in the winding density. One characteristic that plays a prominent roll in this respect is the fact that the properties of the web may differ physically in different directions During the winding of a roll, therefore, a variety of defects can result. These include so-called telescoping, fold formation, nonround coils and the like. Some of these defects may be discoverable only after substantial standing of the rolls.

To overcome these drawbacks, conventional rotary turret or reel-type multiple-station coils have used systems intended to avoid these drawbacks. However, in almost all cases, the contact roller must be brought out of engagement with the roll being wound for at least a brief period sufficient to cause loosening or unwinding of the final turn.

It has been proposed, to overcome this disadvantage, to provide auxiliary contact rolls which can be mounted in a rotary turret or the like or can be provided externally in a so-called follower system. Such systems are rather expensive to construct so that such contact devices with two different contact systems are not widely used and have not been found to be satisfactory heretofore since the use of the system results in a defect in the winding process.

OBJECTS OF THE INVENTION

It is the principal object of the present invention to provide a multiple-station winding machine which avoids release of the last turn of the web, especially at roll changes or replacements and which can be used in in-line processes for the simultaneous winding of a number of webs upon friction sleeves in an in-line process. It may be noted that the in-line process has been found to be an important process for sensitive films for which repeated winding and unwinding should be avoided.

These webs should be wound up immediately upon receipt from the production machine and are frequently slitted into a plurality of adjacent web lengths, and are wound on multiple-station winding machines with throughgoing axes and correspondingly matched empty sleeves.

SUMMARY OF THE INVENTION

These objects and others which will become apparent hereinafter are attained, in accordance with the invention, in a rotary turret winding system having at least two winding positions which are independently rotatable with respect to one another and which cooperate with a contact roller movable in two mutually perpendicular directions and are adapted to be pressed against the sleeve or roll during its formation.

According to the invention, the contact roller presses the free leading end of the web against an empty sleeve positioned in the waiting position and the contact roller remains in contact with the roll as it is wound, even as that roll is swung into the winding position and for the entire duration of the winding in this position.

The contact roller, therefore, remains in contact with each roll as it is wound for the entire duration from the waiting position through coil winding and to the final winding stages thereof.

More particularly, a multi-station winding machine, especially for the winding of thin films and foils and, particularly with an in-line construction for use in the winding of the foil as it arrives from a foil fabrication apparatus, can comprise:

a sleeve holder formed with a plurality of supports for respective winding sleeves independently rotatable about an axis;

a contact roller disposed to engage a first roll of a web forming on one of the sleeves carried by one of the supports at a winding position and to press the web against another of the sleeves carried by another of the supports upon completion of winding of the roll to enable winding of another roll on the other sleeve in a starting position;

cutting means disposed along a path of the web to the positions for severing a trailing end of the first roll from a leading end of the web pressed against the other sleeve to commence winding of the other roll; and mounting means for supporting the contact roller for movement in two mutually perpendicular directions for pressing of the contact roller against the first roll until the first roll is fully wound and against the other roll from commencement of the winding thereof, whereby the contact roller remains in continuous contact with each roll as each roll passes from the starting position to the winding position and for a duration of winding of each roll in the winding position.

The invention allows the multiple-station winding machine to be formed in which the relatively expensive, complex and high-maintenance auxiliary contact rollers can be avoided and yet a continued contact of the contact roller with the roll being wound can be achieved whether that roll is in its starting position, in its winding position or in an intermediate position between the starting an winding positions.

Defective winding resulting from the presence of auxiliary contact rollers or the interruption of contact of the coil with a contact roller can be completely avoided.

It is advantageous, in this regard, to provide the two positions, namely, the starting position and the winding position so that they are independent from on another, i.e. to have the two stations in which the sleeve and the roll are simultaneously bridged by the contact roller, so that they are swingable independently from one another. This allows the two stations to be brought relatively close together so that the contact roller can remain in continuous contact with the wound roll during the final winding operation thereof and simultaneously to be in contact with the empty sleeve in the waiting position as the leading end of the severed web is attached thereto.

As a consequence, an important feature of the invention is that either the sleeve in the waiting position can be swung into contact with the contact roller or the contact roller can be shifted to engage this sleeve in the set in which the contact roller bridges the wound roll and the sleeve.

The contact roller thus has a double function, namely, that of pressing the trailing end of the completed roll after severing against the last turn of the completed roll and that of applying the newly formed lobe of the leading end to the empty sleeve in the waiting position.

The reference to a "lobe" is here intended to refer to the lobe-shape imparted to the leading end of the web by the cutting means so that this leading end forms a tongue of a defined shape as it is applied to the sleeve in the waiting or starting position.

To enhance the entrainment of the leading end of the web by the sleeve in the waiting position, means can be provided for electrostatically charging the leading end of the web so that it is attracted to the sleeve.

According to a further feature of the invention, a deflection roller can be provided to engage the web upstream of the starting position and this deflection roller can be raised and lowered in synchronization with the cutting means to thereby increase the arc over which the web engages the empty sleeve and ensures a firm attachment of the leading end of the web to this sleeve. This deflection roller can be provided with a tension-measuring device.

According to still another feature of the invention, the transverse cutting means is operated synchronously with an adhesive applicator applying an adhesive strip or dot to the newly formed tongue of the leading end of the strip or web to be adhered to the sleeve.

It has been found to be advantageous to provide means for precisely adjusting the level to which the contact roller will rise into engagement with the sleeve, thereby preventing any impact resulting from the movement of the contact roller. For this purpose, a controlled-height abutment may be provided in the form of paired wedges which can be relatively slidable to adjust the maximum height or stroke of the contact roller. Alternative adjustment devices can be eccentric, threaded spindles or like elements.

It has been found to be particularly advantageous to provide the mounting means for the contact roller with an L-shaped frame to which a link is pivotally connected, the contact roller being journaled at the end of a pendulum arm swingable on this link. The vertical component of the movement of the contact roller is contributed by a pneumatic cylinder pivotally connected to the L-shaped frame and to the link. The horizontal component of the movement of the contact roller is contributed by another pneumatic cylinder pivotally connected between the frame and the pendulum arm.

It has been found to be advantageous and especially important to provide this mounting means with a carriage displaceable in a direction transverse to the axis of the rotation turret or star on which the support shaft carrying the sleeves are mounted. This carriage is displaceable from the starting position to the main winding position and the movement of the carriage is superimposed on that of the arm or visa versa. The swinging movement of the contact roller relative to the carriage can be used as a control value in response to which the movement of the carriage is effected. The contact roller thus has a dual function in that the middle position of the contact roller can provide a reference point for control of the carriage and in the main winding position for control of the winding arm.

Since the multiple-station winding machine has its winding station swingable about the aforementioned horizontal axis independently from one another, the overall length of the apparatus can be relatively small, especially when the winding is effected at a lower point in the path of the sleeve. Similar results to those described previously can be obtained when instead of a pendulum arm, the contact roller is mounted upon some other mechanism providing horizontal displaceability

BRIEF DESCRIPTION OF THE DRAWING

The above and other objects, features and advantages of the present invention will become more readily apparent from the following description, reference being made to the accompanying drawing in which.

SPECIFIC DESCRIPTION

Figure 1:
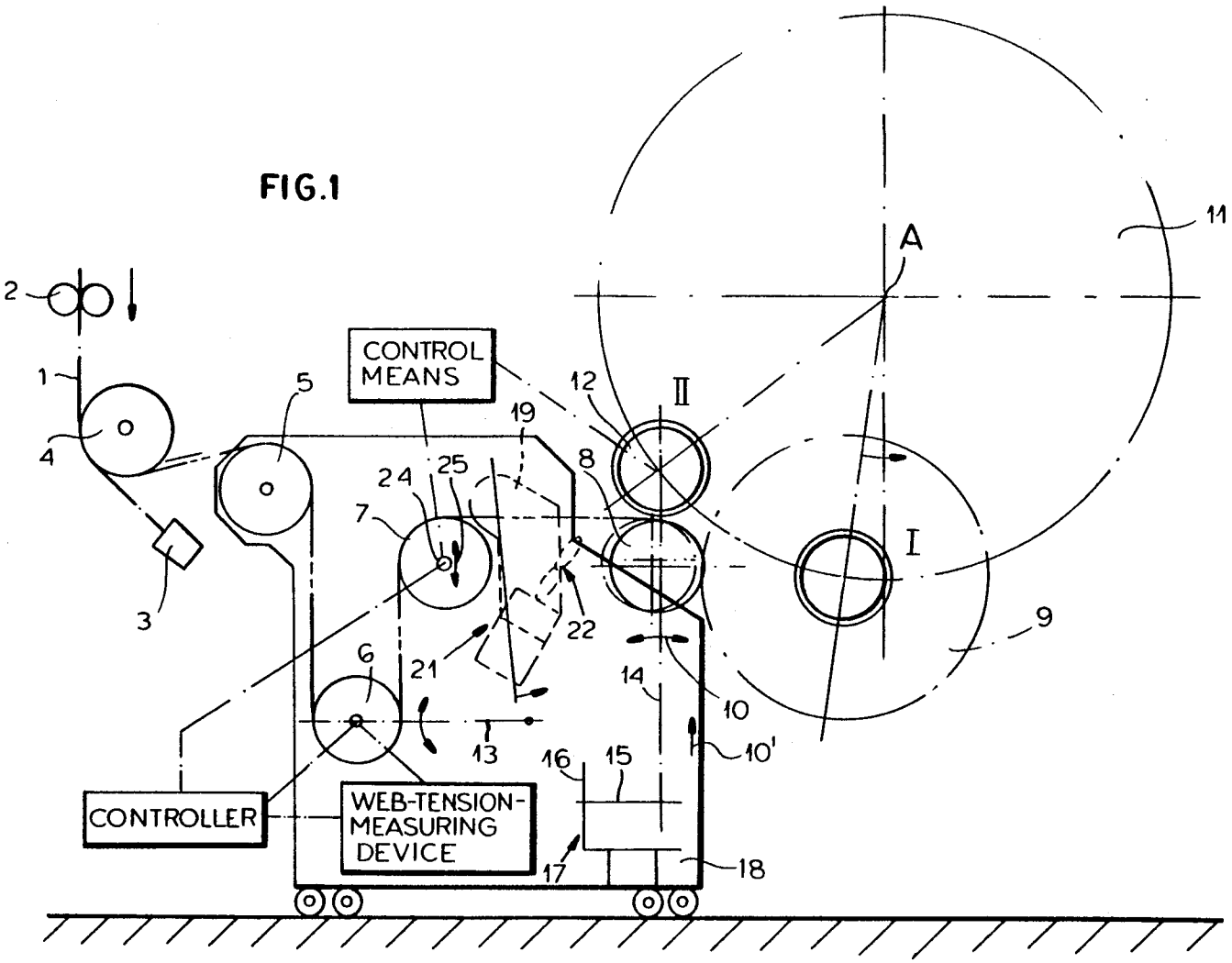
FIG. 1 is a diagrammatic end view of a multiple-station winding machine according to the invention showing a empty sleeve in the waiting position and the transverse cutter in its retracted position.

FIG. 1 shows a coiling apparatus for winding a web 1, for example a thin plastic film, derived from a film-producing machine not otherwise illustrated. The film passes through a longitudinal slitter 2 in which it is subdivided into a multiplicity of strips, each of which is a respective web. Residual strip portions, such as margins which are trimmed off, can be collected by a suction device 3 and recycled to the film-producing apparatus.

The strips are guided via deflection rollers 4 and 5 and pass around a dancer roller 6 before overshooting a further deflection roller 7. From the deflection roller 7 which is vertically shiftable as can be seen by the arrow 25 in FIG. 1 and the dot-dash line position 25' in FIG. 2, the strips pass between a contact roller 8 and a roll of the film disposed at the main winding position I. The almost completed roll at the winding position I is represented at 9.

The winding position I represents the position of the roll as it is wound to completion while the winding position II represents the starting position. As will be apparent from FIG. 1, therefore, the roll core or sleeve which is swingable about the axis A into the winding position I and the core or sleeve swingable about the axis A into the winding position II are carried by independent sets of arms and shafts so that they may be displaced angularly by the winding star or turret 11 about the axis A. In other words, the turret 11 is so constructed that one core or sleeve can assume the position shown at I while another core or sleeve can assume the position at II independently of one another. Naturally, a greater number of cores or sleeves may be accommodated on the arms of the turret as desired.

Thus, while a roll 9 is disposed at the winding position I to be wound to completion, an empty sleeve 12 can be disposed at the position II to receive the web when the roll 9 is completed and can be swung into the position I when the roll 9 is swung out of this position.

The dancer roller 6 is mounted on a swingably journaled arm 13. The contact roller 8, in turn, is rotatably mounted at the end of the pendulum arm 14 which is articulated to a link 15 pivotally connected to an L-shaped frame 16. This frame 16 is part of the mounting means 17 for the contact roller 8 and will be described in greater detail below.

The mounting means is provided on a carriage 18 which simultaneously forms a support for a swingable arm 19 of a cutting unit 21. This cutting unit comprises a transverse cutter 22 with a shear blade arrangement movable transversely to the web, i.e. perpendicular to the plane of the paper in FIG. 1, to cut a leading end of the web from a trailing end thereof.

This transverse cutter can impart an arcuate shape to the cut ends so that, for example, this cut end will have a lobe or tongue shape. The cutting means can include means for slitting the web longitudinally into independent strips each of which is wound upon a respective core or sleeve if a longitudinal slitting device is not provided at 2.

Figure 2:
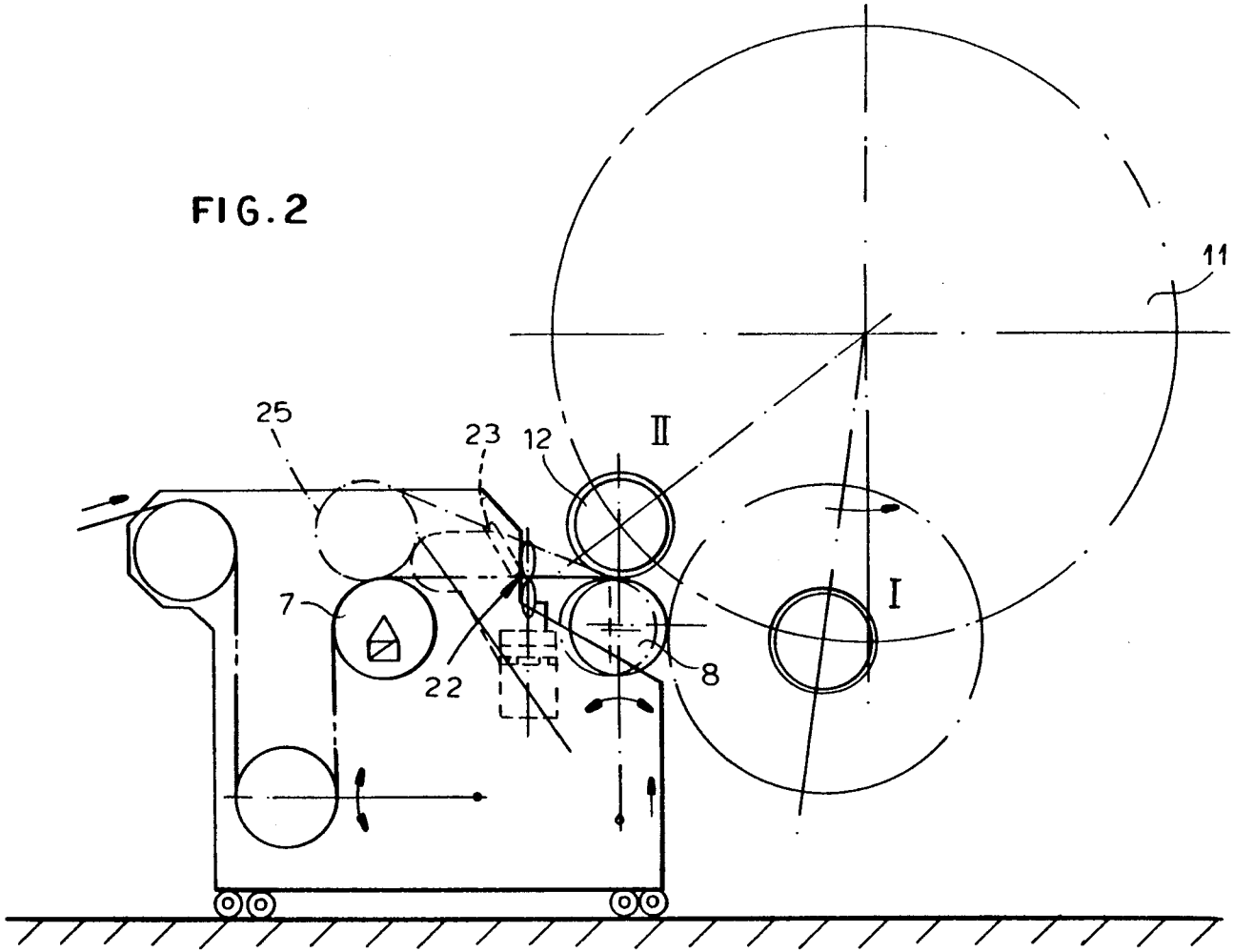
FIG. 2 is a view similar to FIG. 1 with the contact roller bridging the starting winding at the empty sleeve and the finished or completed roll, the transverse cutter being in its operative or active position.

In the cutting position, the circular base unit of the cutting device 22 is in the position shown in FIG. 2, i.e. its operative position, an inoperative position being illustrated in FIG. 1.

The cutting means includes or is synchronized with an attachment unit 23 shown only diagrammatically and advantageously in the form of an adhesive applicator applying an adhesive strip, dot or the like to the leading end of the web as it is applied by the contact roller 8 to the sleeve 12.

The attachment unit 23 can also include means, likewise represented by this reference numeral, for electrostatically charging the tongue of the web so that it is retained by electrostatic force upon the empty sleeve.

Electrostatic means may be used to the exclusion of an adhesive in the case in which the support for the sleeve is a throughgoing shaft or axle and there is a danger of contamination of the reusable axle by an adhesive. Other means which can be used to apply the leading end of the web to the sleeve 12 include air-jet nozzles, a swingable lever or the like.

For precise control of the dancer roller in response to web tension, the deflecting roller 7 can be provided with a web tension measuring unit 24 operatively connected to a controller for the tension which shifts the dancer roller 6.

As has been indicated in FIGS. 1 and 2 as well, the deflection roller 7 can be vertically displaceable (arrow 25) so that it assumes a higher position as shown at 25' in FIG. 2 to increase the length of arc with which the web engages the sleeve 12.

The swingable arm 14 can be swung as represented by the arrow 10 and can be moved upwardly as represented by the arrow 10'. This dual mutually perpendicular movement will be described in greater detail below.

Figure 4:
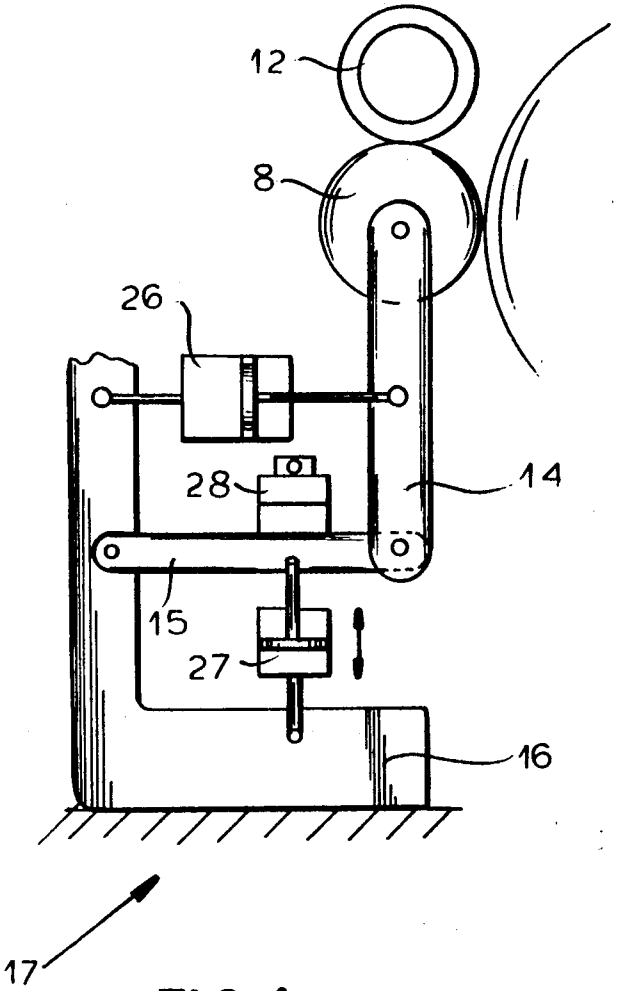
FIG. 4 is a detail view of the means for shifting the contact roller.

FIG. 4 shows details of the mounting means 17.

The link 15 is pivotally connected to the upright shank of the L-shaped frame 16 proximal at the middle thereof. At the opposite end of this link 15, the pendulum arm 14 is swingably mounted and carries the contact roller 8.

The first pneumatic cylinder 26 is pivotally connected between the upper end of the upright shank of the frame 16 and a midpoint of the arm 14. A second pneumatic cylinder 27 is pivotally connected between the link 15 and the lower shank of the frame 16.

While the first cylinder 26 effects the swinging movement of the arm 14, the second cylinder 27 provides the vertical displacement thereof represented by the arrow 10'.

Above the link 1, an adjustment abutment is provided in the form of a pair of relatively shiftable wedges 28. These ensure a stepless control of the upper position of the arm 14 and hence the contact roller 8.

Figure 5:
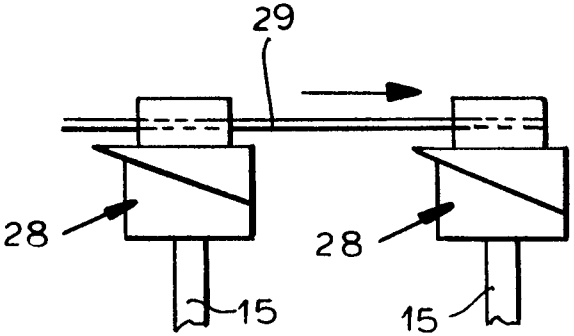
FIG. 5 is a fragmentary side elevational view of the height adjustment device for this system.

As can be seen from FIG. 5, the wedges 28 are provided in two sets with one wedge of each set, i.e. the lower wedge, being stationary and the other wedge, i.e. the upper wedge, being movable by a common bar 29. Via this movement, the upper position of the contact roller can be steplessly controlled so that it will not impact against the empty sleeve 12.

A similar set of wedges can control the lower position of the arm 14.

Figure 6:
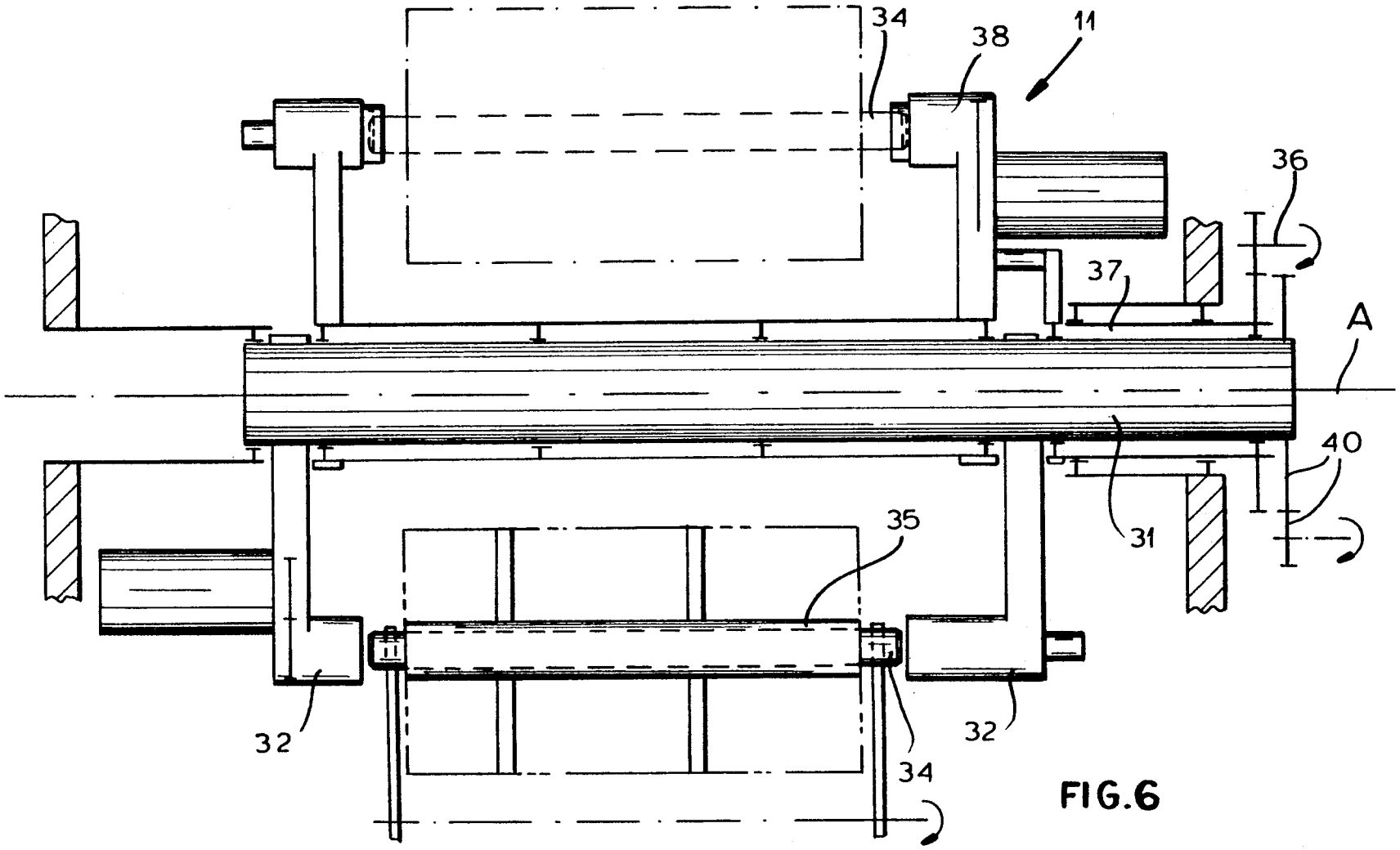
FIG. 6 is a cross sectional view through the turret showing the independently swingable sleeve supports thereof.

The turret 11 has been shown in diagrammatic cross section shown in FIG. 6. As will be apparent from this Figure, the shaft 31 which defines the axis A can be rotatable about this axis by gearing represented at 40. The shaft can carry a pair of arms 32 which can engage a replaceable and reusable support axle 34 carrying the row of friction sleeves 35 on which the cores for the rolls can be slid or which serve to receive the webs themselves. As will be seen from FIG. 6, three rolls of different widths can be wound at each station.

The other winding station is driven independently by the drive 36 via a support sleeve 35 mounted on the shaft 31 and carrying the arms 38 which engage their own support axle 34.

The apparatus shown in the drawing operate as follows. Assuming there is in the winding position I a roll 9 in the process of being wound with the web or strips (FIG. 1) and the strips pass around the dancer roller 6, over the deflection roller 7 and overshoot the contact roller 8 in passing between this contact roller and the roll 9, as the winding of the roll 9 continues, the contact roller 8 recedes by movement of the carriage 18 to the left. The new sleeve 12 is swung into position II. The cutter unit 22, 23 is in its retracted position and the new sleeve 12 in its waiting position.

As winding of the roll 9 is completed, the cutter 22, 23 is brought into its operative position (FIG. 2) and simultaneously the web is pressed against the empty sleeve 12 so that as cutting is effected, the leading end of the oncoming length of web, to which an adhesive dot or strip may be applied and which may be electrostatically charged is drawn against the empty sleeve 12. Concurrently, the roller 7 is raised to the dot-dash position 25' shown in FIG. 2 to increase the arc over which the web is looped against the sleeve 12. As the new sleeve is continuously wound, the roll 9 is swung in the counterclockwise sense into a position in which it can be removed, e.g. by a transfer unit represented at 41 onto a cradle 42 which can carry it away, while the new roll on the sleeve 12 is swung past the contact roller 8 which remains in contact with the newly wound roll all during its movement from the waiting position into winding position I. To permit the roll 12 to pass the contact roller 8, the carriage 18 may be displaced to the left (arrow 39).

A computer can control the position of the carriage 18 and the mutually perpendicular movements of the contact roller 8 on the carriage 18 as desired.

The position of the pendulum arm can be utilized as a control signal for the movement of the carriage.

Figure 3:
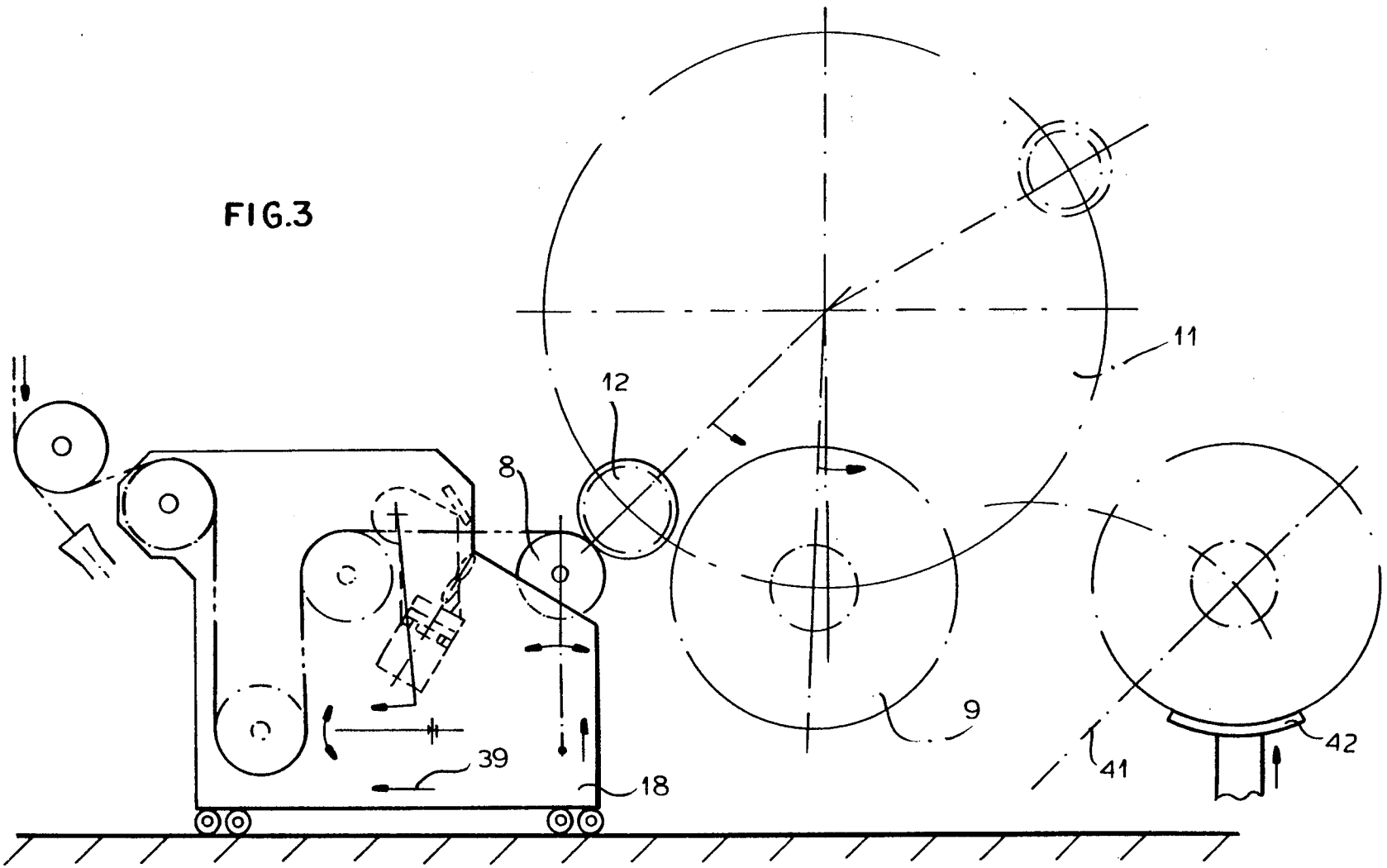
FIG. 3 is another view similar to FIG. 1 wherein, however, the removal of a finished roll has been illustrated and the movement of the roll in the process of formation of the main winding position is in progress.

A new sleeve can be substituted for the finished roll 9 either at the location at which the finished roll is removed or sore other location along the path of the arms as represented by the dot-dash line 11 in FIG. 3 and before the sleeve 12 arrives in the waiting position II.

The system has been found to be particularly effective for use in the winding of a plurality of strips in an in-line process for scratch-sensitive films and apart from its use in a turret system it also may be employed as a component of roll cutting and winding positions generally.

We claim:

1. A multiple-station winding machine, comprising:

a sleeve holder formed with a plurality of supports for respective winding sleeves independently rotatable about an axis;

a contact roller disposed to engage a first roll of a web forming on one of said sleeves carried by one of said supports at a winding position and to press said web against another of said sleeves carried by another of said supports upon completion of winding of said roll to enable winding of another roll on said other sleeve in a starting position;

cutting means disposed along a path of said web to said positions for severing a trailing end of said first roll from a leading end of the web pressed against said other sleeve to commence winding of said other roll; and mounting means for supporting said contact roller for movement in two mutually perpendicular directions for pressing of said contact roller against said first roll until said first roll is fully wound and against said other roll from commencement of the winding thereof whereby said contact roller remains in continuous contact with each roll as each roll passes from said starting position to said winding position and for a duration of winding of each roll in said winding position.

2. The machine defined in claim I wherein said contact roller bridges between said first roll and said other sleeve at least briefly prior to severing of said web.

3. The machine defined in claim 2 wherein said contact roller is brought into bridging engagement with said other roll and said first roll by swinging said sleeve toward said contact roller.

4. The machine defined in claim 2 wherein said contact roller bridges between said other sleeve and said first roll by shifting of said contact roller.

5. The machine defined in claim 4 wherein the bridging of said other sleeve and said first roll is effected by controlled lifting of said contact roller to engage said other sleeve in said starting position.

6. The machine defined in claim 5, further comprising a pair of relatively shiftable wedges forming a stop for displacement of said contact roller.

7. The machine defined in claim 1 wherein said mounting means includes:

a substantially L-shaped frame;

a link pivotally connected to said frame;

a pendulum arm articulated to said link and carrying said contact roller;

a first pneumatic cylinder pivotally connected to said frame and to said arm; and a second pneumatic cylinder pivotally connected to said link and said frame.

8. The machine defined in claim 7, further comprising a carriage displaceable in the direction generally transverse to said axis, said frame being mounted on said carriage.

9. The machine defined in claim 8 wherein said arm impacts a movement to said contact roller superimposed upon the movement of said contact roller by said carriage.

10. The machine defined in claim 9, further comprising means responsive to a pendulum movement of said contact roller for controlling movement of said carriage.

11. The machine defined in claim 9, further comprising means for electrostatically charging said free end of said web for adhering same to said other sleeve.

12. The machine defined in claim 1, further comprising deflection roller means engageable with said web upstream of said cutting means and shiftable to impart a preliminary bend of said web around said other sleeve.

13. The machine defined in claim 12 wherein said deflection roller is provided with a web-tension-measuring device.

14. The machine defined in claim 1, further comprising means coupled with said cutting means for applying adhesive to said leading end of said web.

15. The machine defined in claim 1 wherein said supports are axles each carrying a plurality of friction sleeves for winding respective stretches of said web.

16. A method of operating a winding machine for winding a web, comprising the steps of:

(a) winding an oncoming web on a first roll carried by a support rotatable about a horizontal axis while pressing a contact roller against said first roll and feeding said web to said first roll between said contact roller and said first roll;

(b) rotating a support carrying an empty sleeve into a waiting position about said axis proximal to said first roll;

(c) upon completion of winding of said first roll, displacing said contact roller to press said web against said sleeve, thereby bridging said contact roller between said sleeve and said first roll;

(d) transversely severing said web to cut a trailing end thereof wound on said first roll from a leading end of said web applied to said sleeve;

(e) rotating said first roll about said axis and removing same and swinging said sleeve with said web winding thereon into a winding position from a waiting position while maintaining contact of said contact roller with the web wound on said sleeve, thereby winding a second roll at said winding position while maintaining contact of said contact roller therewith; about said axis; and (g) repeating steps (a)-(f) to wind additional rolls on respective sleeves with said web.

* * * * *